US010279353B2

(12) United States Patent
Nied et al.

(10) Patent No.: US 10,279,353 B2
(45) Date of Patent: May 7, 2019

(54) OPERATING METHOD FOR A GRINDING BODY MILL AND GRINDING BODY MILL FOR THE SAME

(71) Applicants: Netzsch Trockenmahltechnik GmbH, Selb (DE); Roland Nied, Bonstetten (DE)

(72) Inventors: Roland Nied, Bonstetten (DE); Lars-Peter Weiland, Schönwald (DE)

(73) Assignee: Netzsch Trockenmahltechnik, Selb (DE)

( * ) Notice: Subject to any disclaimer, the term of this patent is extended or adjusted under 35 U.S.C. 154(b) by 1082 days.

(21) Appl. No.: 14/576,449

(22) Filed: Dec. 19, 2014

(65) Prior Publication Data

US 2015/0174583 A1 Jun. 25, 2015

(30) Foreign Application Priority Data

Dec. 20, 2013 (DE) ..... 10 2013 021 756

(51) Int. Cl.
*B02C 17/16* (2006.01)
*B02C 17/18* (2006.01)

(52) U.S. Cl.
CPC ..... *B02C 17/161* (2013.01); *B02C 17/16* (2013.01); *B02C 17/183* (2013.01); *B02C 17/184* (2013.01); *B02C 17/1835* (2013.01)

(58) Field of Classification Search
CPC ..... B02C 17/161; B02C 17/16; B02C 17/183
See application file for complete search history.

(56) References Cited

U.S. PATENT DOCUMENTS 4,936,513 A * 6/1990 Smith ..... B02C 17/16 241/171
5,690,285 A * 11/1997 Brisbois ..... B02C 17/22 241/172
8,702,023 B2 * 4/2014 Enderle ..... B02C 17/161 241/171
8,814,071 B2 * 8/2014 Jeker ..... B02C 17/163 241/171

FOREIGN PATENT DOCUMENTS

JP S60155937 U * 10/1985 ..... B02C 17/00

* cited by examiner

*Primary Examiner* — Shelley M Self
*Assistant Examiner* — Joseph Finan
(74) *Attorney, Agent, or Firm* — Mandelbaum Silfin Economou LLP

(57) ABSTRACT

A mill and operating method for using grinding bodies for grinding a grinding stock. Grinding bodies that have passed through the through the product outlet enter an upwardly inclined discharge pipe from where, when the grinding body mill is at a standstill, the grinding bodies are directed out of the discharge pipe through the product outlet into a rotor body of the separating device. When operation of the grinding body mill is resumed, the grinding bodies are conveyed back into the grinding chamber owing to the rotation of the rotor body.

10 Claims, 2 Drawing Sheets

OPERATING METHOD FOR A GRINDING BODY MILL AND GRINDING BODY MILL FOR THE SAME

BACKGROUND OF THE INVENTION

The present invention relates to an operating method for a grinding body mill, such as for example a stirred ball mill and to a grinding body mill for carrying out said operating method.

A stirred ball mill known from practice, which is an example of a grinding body mill 1 in general and which is schematically illustrated in FIG. 2 in a sectional view, comprises a grinding chamber 3 which is surrounded by a housing 2 and into which grinding stock 5 to be milled is fed through a product inlet 4. In the grinding chamber 3 there are contained grinding bodies 6 and an agitator 7 with a rotor 8, the rotation of which serves to generate the intensive movement of the grinding bodies 6, whereby the grinding stock 5 to be milled is milled. On the axial end of the rotor 8 there is situated an in particular co-rotating separating device 9 serving for separation between grinding bodies 6 and grinding stock 5 that has still to be milled, on the one hand, as well as fully ground grinding stock 10, on the other hand, and being positioned upstream of a product outlet 11 in the housing 2.

The separating device 9 is formed for example by a bladed rotor body 12 which rotates together with the rotor 8 and which is designed and operated with the intention of preventing grinding bodies 6 from passing through it, by virtue of the separating device 9, in particular by way of the size of the intermediate spaces between the blades 13 of the bladed rotor body 12 and the rotational movement of the bladed rotor body 12, deflecting the grinding bodies 6 and thus preventing them from passing through the separating device 9 from the grinding chamber 3 into the product outlet 11. Whereas, during normal operation of the mill, the rotation of the separating device 9 alone ensures that grinding bodies 6 are reliably predominantly prevented from passing through the separating device 9 and exiting the grinding body mill 1 or the grinding chamber 3 thereof through the product outlet 11, it is the case in particular in braking phases of the rotor 8 that, owing to the relatively low rotational speed of the rotor 8 and thus of the bladed rotor body 12 of the separating device 9, individual grinding bodies 6 pass through the latter from the grinding chamber 3 into the product outlet 11. This may however also occur during normal operation if the dimensions of grinding bodies 6 have decreased as a result of wear.

Such grinding bodies that have escaped from the grinding chamber 3 must, on the one hand, separately be removed from the fully ground grinding stock 10, specifically as far as possible without impeding a continuous flow of grinding stock. To maintain a predefined quantity of grinding bodies in the grinding chamber 3 despite resulting grinding body losses, it is, on the other hand, also necessary to repeatedly perform replenishment of grinding bodies, for which purpose cumbersome determinations and monitoring of the corresponding quantity of grinding bodies are necessary. All of this entails additional outlay for the operation of a grinding body mill.

The recirculation of grinding bodies is disclosed in DE 27 44 802 A1 and in US 2 332 01 A, albeit with considerable outlay.

DE 24 46 341 A1 and DE 31 31 370 A1 are concerned generally with stirred ball mills. All of said mills lack a co-rotating separating device upstream of a product outlet.

SUMMARY OF THE INVENTION

It is an aim of the present invention to improve a grinding body mill such that a loss of grinding bodies at the product outlet is reduced or prevented in a simple manner.

Said aim is achieved according to the invention by means of an operating method for a grinding body mill and by means of a grinding body mill.

The invention correspondingly provides an operating method for a grinding body mill having a housing which surrounds a grinding chamber in which grinding bodies are arranged and, during normal operation, are set in motion for the purpose of grinding a grinding stock to be ground, which housing comprises a product inlet and a product outlet, between which the grinding stock to be ground flows through the moving grinding bodies, wherein, by means of a separating device positioned upstream of the product outlet, grinding bodies are prevented from exiting the grinding chamber into the product outlet during normal operation of the grinding body mill. According to the invention, it is also provided that grinding bodies that have passed through the separating device and onward through the product outlet pass into an upwardly inclined discharge pipe from where, when the grinding body mill is at a standstill, said grinding bodies are directed out of the discharge pipe through the product outlet into a rotor body of the separating device and, when operation of the grinding body mill is resumed, said grinding bodies are conveyed back into the grinding chamber owing to the rotation of the rotor body.

The discharge pipe is preferably inclined upward by 2° to 15°, in particular by 3° to 10° and particularly preferably by 4° to 6° with respect to the horizontal.

Yet a further preferred configuration consists in the grinding body mill being a stirred ball mill.

The invention also provides a grinding body mill having a housing which surrounds a grinding chamber in which grinding bodies are arranged and, during normal operation, are set in motion for the purpose of grinding a grinding stock to be ground, which housing comprises a product inlet and a product outlet, between which the grinding stock to be ground flows through the moving grinding bodies, wherein a separating device is positioned upstream of the product outlet, which separating device is designed to prevent grinding bodies from exiting the grinding chamber into the product outlet during normal operation of the grinding body mill. According to the invention, it is also provided here that, downstream of the product outlet, there is positioned a discharge pipe which is inclined upward with respect to the horizontal, and that the separating device comprises a rotor body which is positioned upstream of the product outlet and which, during operation, rotates and thus forces grinding bodies radially outwards, such that grinding bodies that have passed into the discharge pipe are, owing to the upward inclination of the discharge pipe with respect to the horizontal, directed out of the discharge pipe through the product outlet into the rotor body when the grinding body mill is at a standstill, and when operation of the grinding body mill is resumed, said grinding bodies are conveyed back into the grinding chamber owing to the rotation of the rotor body.

A preferred refinement of said grinding body mill consists in that the discharge pipe is inclined upward by 2° to 15°, in particular by 3° to 10° and particularly preferably by 4° to 6° with respect to the horizontal.

The grinding body mill may preferably be a stirred ball mill.

Further preferred and/or advantageous refinements of the invention and of the individual aspects thereof will emerge from the present application documents in their entirety.

DESCRIPTION OF THE DRAWINGS

The invention will be explained in more detail below on the basis of exemplary embodiments, merely by way of example, with reference to the drawing, in which.

DESCRIPTION OF THE PREFERRED EMBODIMENT

Figure 1:
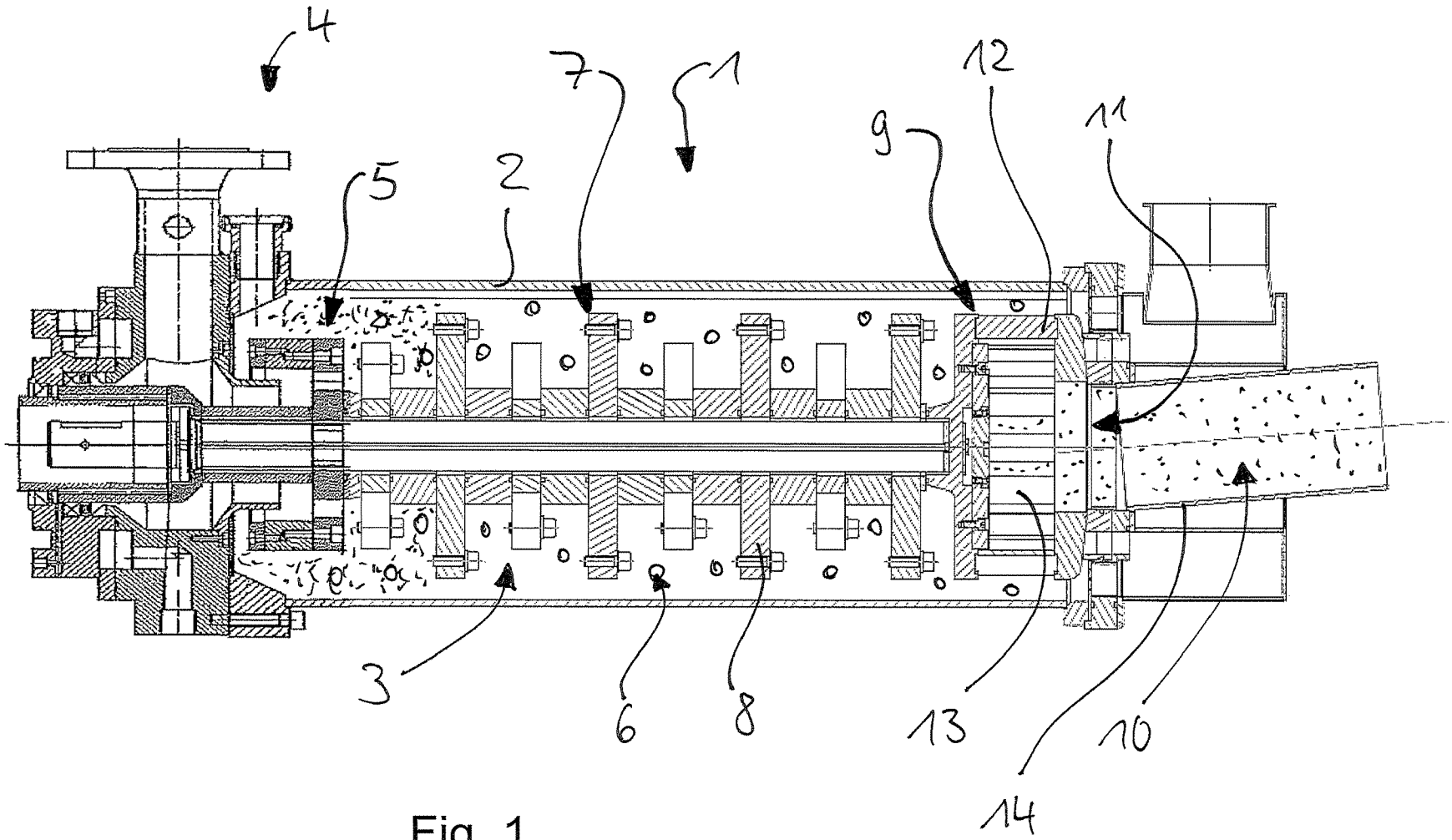
FIG. 1 shows a schematic sectional view of a first exemplary embodiment of a grinding body mill.

The invention will be explained in more detail merely by way of an example on the basis of the design and usage examples described below and illustrated in the drawings, that is to say the invention is not restricted to said design and usage examples. Method and device features will emerge in each case analogously also from device and method descriptions.

Individual features that are specified and/or illustrated in conjunction with a specific exemplary embodiment are not restricted to said exemplary embodiment or to combination with the other features of said exemplary embodiment, but may, within the scope of technical possibility, be combined with any other variants, even variants that are not discussed separately in the present documents.

Identical reference signs in the individual figures and images of the drawing are used to denote identical or similar components, or components of identical or similar function. From the illustrations in the drawing, features not denoted by reference signs also become apparent, regardless of whether or not such features are described below. On the other hand, features which are included in the present description but which are not visible or illustrated in the drawing are also readily understandable to a person skilled in the art.

Figure 2:
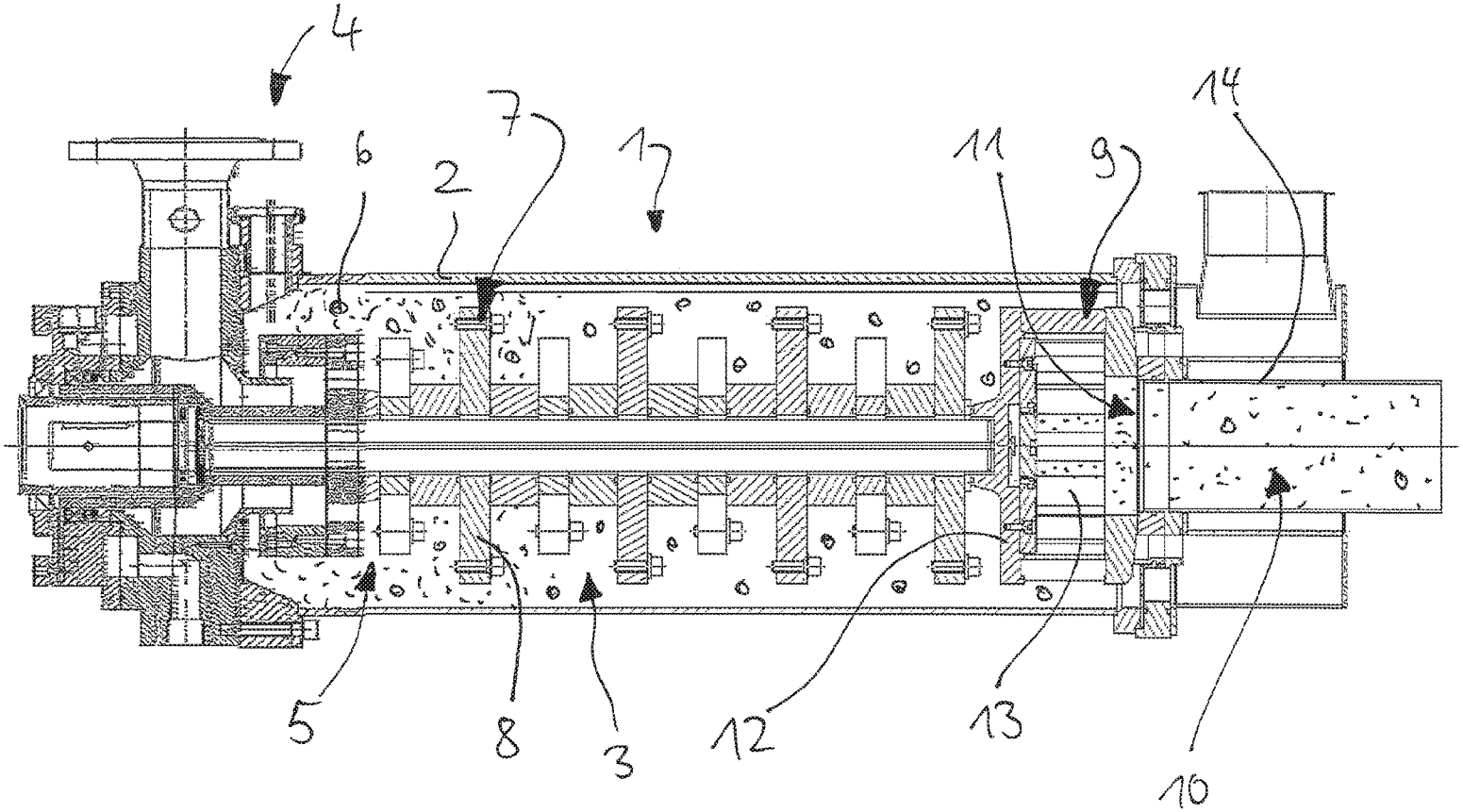
PRIOR ART Fig. 2
FIG. 2 shows a schematic sectional view of a grinding body mill according to the prior art.

The first exemplary embodiment of a grinding body mill 1 as per FIG. 1 comprises, in the same way as and also in concordance with the grinding body mill 1 according to the prior art in FIG. 2, the grinding chamber 3 which is surrounded by the housing 2 and into which the grinding stock 5 to be milled is fed through the product inlet 4. In the grinding chamber 3 there are contained the grinding bodies 6 and the agitator 7 with the rotor 8, the rotation of which serves to generate the intensive movement of the grinding bodies 6, whereby the grinding stock 5 to be milled is milled. On the axial end of the rotor 8 there is situated the in particular co-rotating separating device 9 serving for separation between grinding bodies 6 and grinding stock 5 that has still to be milled, on the one hand, as well as fully ground grinding stock 10, on the other hand, and being positioned upstream of the product outlet 11 in the housing 2. The grinding body mill 1 in FIGS. 1 and 2 is in each case a stirred ball mill, which is a particularly preferred use of the invention, to which the invention is however not restricted.

In the case of a stirred ball mill 1 of said type, the separating device 9 exemplarily is formed by the bladed rotor body 12 which rotates together with the rotor 8, and is designed and operated with the intention of preventing grinding bodies 6 from passing through it, by virtue of the separating device 9, in particular by way of the size of the intermediate spaces between the blades 13 of the bladed rotor body 12 and the rotational movement of the bladed rotor body 12, deflecting the grinding bodies 6 and thus preventing them from passing through the separating device 9 from the grinding chamber 3 into the product outlet 11. Whereas, during normal operation of the mill, the rotation of the separating device 9 alone ensures that grinding bodies 6 are reliably predominantly prevented from passing through the separating device 9 and exiting the grinding body mill 1 or the grinding chamber 3 thereof through the product outlet 11, it is the case in particular in braking phases of the rotor 8 that, owing to the relatively low rotational speed of the rotor 8 and thus of the bladed rotor body 12 of the separating device 9, individual grinding bodies 6 pass through the latter from the grinding chamber 3 into the product outlet 11. This may however also occur during normal operation if the dimensions of grinding bodies 6 have decreased as a result of wear.

In the case of grinding body mills 1 according to the prior art, such grinding bodies that have passed out of the grinding chamber 3 must, on the one hand, separately be removed from the fully ground grinding stock 10, specifically as far as possible without impeding a continuous flow of grinding stock. To maintain a predefined quantity of grinding bodies in the grinding chamber 3 despite resulting grinding body losses, it is, on the other hand, also necessary to perform constant replenishment of grinding bodies, for which purpose cumbersome determinations and monitoring of the corresponding quantity of grinding bodies are necessary. All of this entails additional outlay for the operation of a grinding body mill.

The present invention remedies this in that, downstream of the product outlet 11, there is positioned a discharge pipe 14 which is inclined with respect to the horizontal. Said inclination of the discharge pipe 14 is in the upward direction in the case of the grinding body mill of the first exemplary embodiment as per FIG. 1. The discharge pipe 14 is preferably inclined upward by 2° to 15°, in particular by 3° to 10° and particularly preferably by 4° to 6° with respect to the horizontal.

In the case of the grinding body mill 1 of the first exemplary embodiment as per FIG. 1, it is provided that the discharge pipe 14 is inclined towards the top or upward with respect to the horizontal, and that the separating device 9 comprises the rotor body 12 which is positioned upstream of the product outlet 11 and which, during operation, rotates and thus forces grinding bodies 6 radially outwards, such that grinding bodies 6 that have passed into the discharge pipe 14 are, owing to the upward inclination of the discharge pipe 14 with respect to the horizontal, directed out of the discharge pipe 14 through the product outlet 11 into the rotor body 12 when the grinding body mill 1 is at a standstill, and when operation of the grinding body mill 1 is resumed, said grinding bodies are conveyed back into the grinding chamber 3 owing to the rotation of the rotor body 12.

In other words, an operating method for a grinding body mill 1 of the first exemplary embodiment as per FIG. 1 provides that the grinding bodies that have passed through the separating device 9 and onward through the product outlet 11 pass into the upwardly inclined discharge pipe 14 from where, when the grinding body mill 1 is at a standstill, said grinding bodies are directed out of the discharge pipe 14 through the product outlet 11 into a rotor body 12 of the separating device 9 and, when operation of the grinding body mill 1 is resumed, said grinding bodies are conveyed back into the grinding chamber 3 owing to the rotation of the rotor body 12.

A particular advantage of the design of the first exemplary embodiment of the grinding body mill 1 with the upwardly inclined discharge pipe 14 is that, without further equipment and measures, and simply through utilization of the force of gravity within the upwardly inclined discharge pipe 14, at least whenever the transport flow through the product outlet 11 slows and finally stops when the grinding body mill 1 is deactivated, the grinding bodies 6 that have incorrectly escaped from the grinding chamber 3 through the product outlet 11 into the discharge pipe 14 automatically slide or roll back into the separating device 9 through the product outlet 11. At least whenever the grinding body mill 1 is started up again, it is then the case, at any rate for as long as there is not yet a sufficiently intense flow of fully ground grinding stock 10 through the separating device 9 and onward through the product outlet 11, that the grinding bodies 6 that have collected in the separating device 9 are conveyed or centrifuged back into the grinding chamber 3 again owing to the rotational movement of the separating device 9. In this embodiment, the returned grinding bodies 6 thus enter the grinding chamber 3 again at the discharge end, that is to say in the region of the product outlet 11, and are thus returned to the grinding process and, from then onward, participate in the grinding process again.

Further details of grinding body mills and in particular stirred ball mills with regard to the grinding process will not be discussed in any more detail here, because it is assumed that a person skilled in the art is familiar with said details for different configurations and operating variants, and because such details relating to the grinding process do not contribute to the present invention.

The invention has been presented merely by way of an example on the basis of the exemplary embodiments in the description and in the drawing, and is not restricted thereto but encompasses all variations, modifications, substitutions and combinations which emerge to a person skilled in the art from the present documents, in particular from the general explanations in the introductory part of this description and from the description of the exemplary embodiments, and which a person skilled in the art can combine with his expert knowledge and the prior art. In particular, all of the individual features and design options of the invention can be combined.

The invention claimed is:

1. Operating method for a grinding body mill having a housing with a product inlet and a product outlet which housing surrounds a grinding chamber in which grinding bodies are arranged for the purpose of grinding a grinding stock to be ground, comprising transporting the grinding stock to be ground through the moving grinding bodies, providing a separating device positioned upstream of the product outlet, preventing grinding bodies from exiting the grinding chamber into the product outlet during normal operation of the grinding body mill, directing grinding bodies that have passed through the separating device and onward through the product outlet to pass into an upwardly inclined discharge pipe, and when the grinding body mill is at a standstill, directing said grinding bodies out of the discharge pipe through the product outlet into a rotor body of the separating device and, when operation of the grinding body mill is resumed, conveying said grinding bodies back into the grinding chamber owing to the rotation of the rotor body.

2. Operating method for a grinding body mill according to claim 1, wherein the discharge pipe is inclined by 2° to 15° with respect to the horizontal.

3. Operating method for a grinding body mill according to claim 2, wherein the discharge pipe is inclined by 3° to 10° with respect to the horizontal.

4. Operating method for a grinding body mill according to claim 3, wherein the discharge pipe is inclined by 4° to 6° with respect to the horizontal.

5. Operating method for a grinding body mill according to claim 1, wherein the grinding body mill is a stirred ball mill.

6. Grinding body mill having a housing which surrounds a grinding chamber in which grinding bodies are arranged and, during normal operation, are set in motion for the purpose of grinding a grinding stock to be ground, which housing comprises a product inlet and a product outlet, between which the grinding stock to be ground flows through the moving grinding bodies, wherein a separating device is positioned upstream of the product outlet, which separating device is designed to prevent grinding bodies from exiting the grinding chamber into the product outlet during normal operation of the grinding body mill, wherein downstream of the product outlet, there is positioned a discharge pipe which is inclined upward with respect to the horizontal, and the separating device comprises a rotor body which is positioned upstream of the product outlet and which, during operation, rotates and thus forces grinding bodies radially outwards, such that grinding bodies that have passed into the discharge pipe are, owing to the upward inclination of the discharge pipe with respect to the horizontal, directed out of the discharge pipe through the product outlet into the rotor body when the grinding body mill is at a standstill, and when operation of the grinding body mill is resumed, said grinding bodies are conveyed back into the grinding chamber owing to the rotation of the rotor body.

7. Grinding body mill according to claim 6, wherein the discharge pipe is inclined upward by 2° to 15° with respect to the horizontal.

8. Grinding body mill according to claim 7, wherein the discharge pipe is inclined upward by 3° to 10° with respect to the horizontal.

9. Grinding body mill according to claim 8, wherein the discharge pipe is inclined upward by 4° to 6° with respect to the horizontal.

10. Grinding body mill according to claim 6, wherein the grinding body mill is a stirred ball mill.

* * * * *